US007992281B2

(12) United States Patent
Järvinen et al.

(10) Patent No.: US 7,992,281 B2
(45) Date of Patent: Aug. 9, 2011

(54) METHOD AND APPARATUS FOR ATTACHING A LIFTING LUG TO A CONCRETE PRODUCT

(75) Inventors: Lassi Järvinen, Valkeakoski (FI); Aimo Seppänen, Sääksmäki (FI)

(73) Assignee: Elematic Group OY, Toijala (FI)

( * ) Notice: Subject to any disclaimer, the term of this patent is extended or adjusted under 35 U.S.C. 154(b) by 1063 days.

(21) Appl. No.: 11/822,852

(22) Filed: Jul. 10, 2007

(65) Prior Publication Data

US 2008/0010926 A1 Jan. 17, 2008

(30) Foreign Application Priority Data

Jul. 12, 2006 (FI) ..... 20060678

(51) Int. Cl.
*B21B 1/46* (2006.01)
*E04B 1/21* (2006.01)

(52) U.S. Cl. ..... 29/527.2; 52/333

(58) Field of Classification Search ..... 29/527.2, 29/527.3, 527.4, 530, 897, 897.1, 897.34; 52/333

See application file for complete search history.

(56) References Cited

FOREIGN PATENT DOCUMENTS

| | | | |
|---|---|---|---|
| DE | 3219139 | A1 | 11/1983 |
| DK | 168695 | B1 | 3/1993 |
| EP | 1344877 | A1 | 9/2003 |
| EP | 1555100 | A1 | 7/2005 |
| FR | 2784703 | A1 | 4/2000 |
| WO | WO 01/21905 | A2 | 3/2001 |

OTHER PUBLICATIONS

Finnish Office Action dated Apr. 10, 2007.
Finnish Office Action dated Mar. 3, 2010.

*Primary Examiner* — John C Hong
(74) *Attorney, Agent, or Firm* — Buchanan Ingersoll & Rooney PC

(57) ABSTRACT

Method and apparatus for attaching a part forming a lifting lug to fresh, prestressed hollow-core slab or massive slab, wherein the part forming the lifting lug is embedded by vibrating at least partly through the upper surface of the slab, after which the part forming the lifting lug is turned by vibrating, so that the lower parts of the lifting lug set themselves under the reinforcing strands of the slab.

3 Claims, 6 Drawing Sheets

METHOD AND APPARATUS FOR ATTACHING A LIFTING LUG TO A CONCRETE PRODUCT

Figure 1:
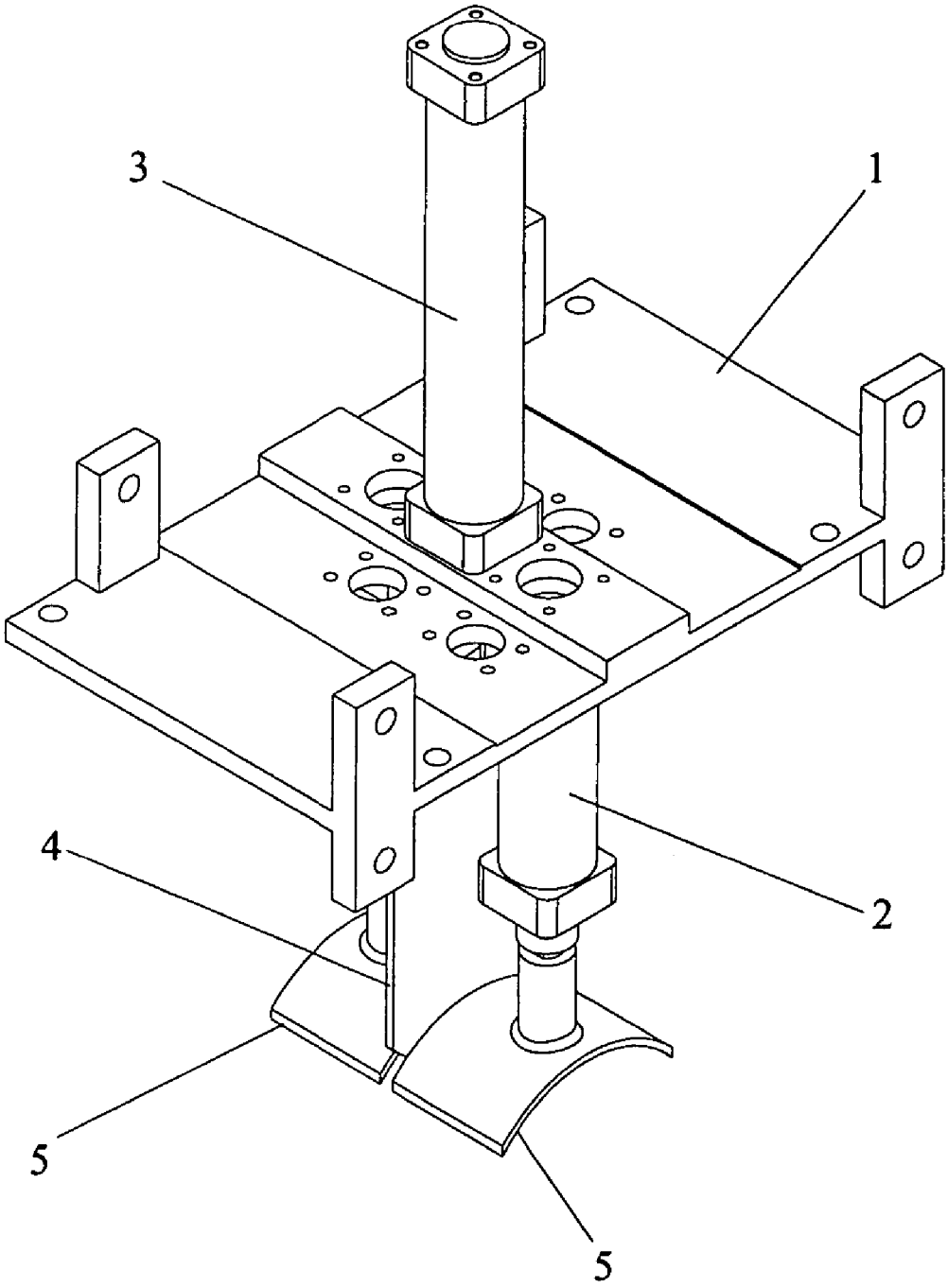

The present invention concerns attaching of lifting lugs to a product cast of concrete and provided with prestressed reinforcing strands, like to a hollow-core slab or a massive slab.

For lifting and moving of hollow-core slabs and massive slabs it is often necessary to provide the ready cast slabs with lifting lugs. Traditionally the lugs are mounted manually in the concrete slab factory when manufacturing the slab.

In one method known in the art for attaching lifting lugs, the lifting lugs are positioned to the cast hollow-core slab at the hollow cores, whereby the upper surface of the slab is removed at a predetermined place and predetermined length at the hollow core of the hollow-core slab, the opened ends of the hollow core are plugged e.g. by means of plugs made of plastic or by means of added concrete mass, and the lifting lug is positioned to the provided space. After that, the space of the hollow-core slabs defined by the plugs is refilled with concrete mass up to the level of the upper surface of the hollow-core slab. In this kind of a solution the lifting lug comprises a cup-like portion having its upper edges limited to the level of the upper surface of the hollow-core slab, and the lug portion of the lifting lug sets itself substantially in the middle of the cup, so that the uppermost part thereof is located substantially at the level of the upper surface of the cast hollow-core slab.

In another solution known in the art, the lifting lug is formed of a wire cable lug that is located into an opening formed to the hollow-core slab aligned with the hollow core, as described above. A steel bar is mounted inside the hollow-core slab to the lower edge of the wire cable lug, said steel bar extending through the lug and being perpendicular to the lug. After that the opening of the hollow-core slab is filled with concrete up to the level of the upper surface of the slab, whereby the upper part of the wire cable lug stays above the upper surface of the hollow-core slab forming thus a lifting lug for lifting the hollow-core slab.

It is also known in the art to use lifting lugs bent of reinforcement steel, to be cast to an opened and plugged hollow core so that the lug portion of the lifting lug remains above the upper surface of the slab.

One problem with the solutions known in the art described above is that especially when lifting heavy hollow-core slabs, the upper surface of the slab can be broken at the lifting lugs, and the lifting lugs can be loosened from the hollow-core slab during the lifting. Additionally, a lot of manual work is required by the methods known in the art for mounting the lifting lugs, which extends the manufacturing time of the hollow-core slabs.

According to the present invention, a part forming the lifting lug is attached to the fresh, i.a. the freshly cast hollow-core slab or massive slab provided with reinforcing strands, so that the part forming the lifting lug is embedded by vibrating through the upper surface of the slab inside the slab so that when the upper edge of the part forming the lifting lug is at the level of the upper surface of the slab or below that, the part forming the lifting lug is turned so that the lower ends of the part forming the lifting lug set themselves under the reinforcing strands. In that way the attached lifting lug can be supported to the reinforcing strands of the cast slab, which significantly strengthens the attachment of the lifting lug to the slab.

In another embodiment according to the invention, the upper surface of the slab is broken at the hollow core for mounting the lifting lug, and the opened ends of the hollow core are plugged with the concrete mass of the upper surface. In the formed space, the part forming the lifting lug is mounted so that the part forming the lifting lug is turned simultaneously with the vibrating, so that the lower ends of the part forming the lifting lug are pushed inside the adjacent necks of the hollow core and there under the reinforcing strands. In connection with the mounting of the lifting lug, either before the mounting of the lifting lug, simultaneously with or after the mounting of the lifting lug, the formed space is filled with concrete and compacted by vibrating.

By means of the solution according to the present invention it can be secured, that the lifting lug will stay in place even when lifting heavy hollow-core slabs, and the damages to the hollow-core slab caused by loosening of the lifting lug can be prevented.

More precisely, the method in accordance with the invention is characterized by what is stated in the characterizing part of Claim 1, and the apparatus in accordance with the invention is characterized by what is stated in the characterizing part of Claim 9.

Figure 2A:
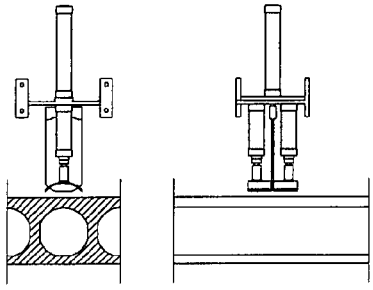
Figure 2B:
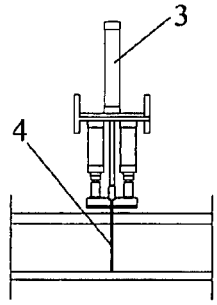
Figure 2C:
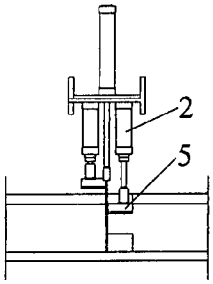
Figure 2D:
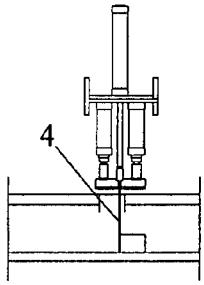
Figure 2E:
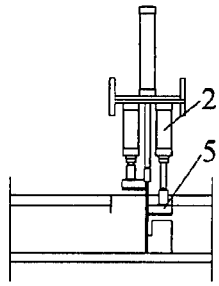
Figure 2F:
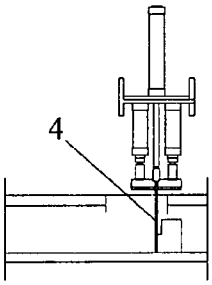
Figure 2G:
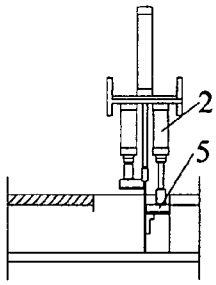
Figure 2H:
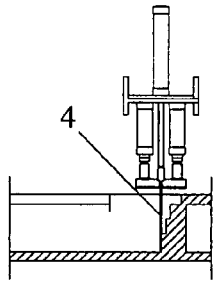
Figure 2I:
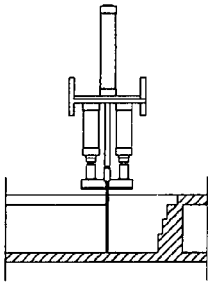
Figure 2J:
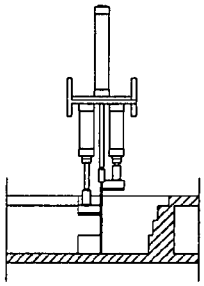
Figure 2K:
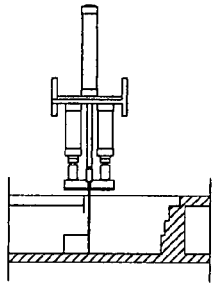
Figure 2L:
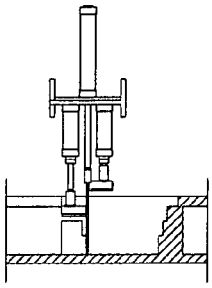
Figure 2M:
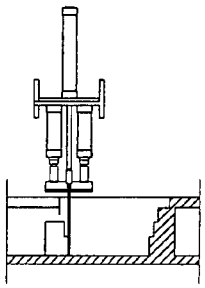
Figure 2N:
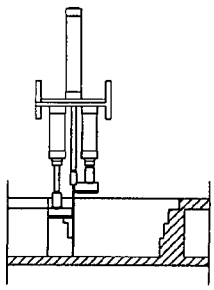
Figure 2O:
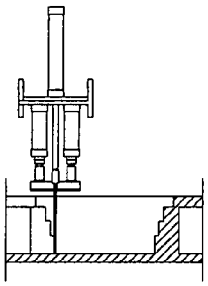
Figure 2P:
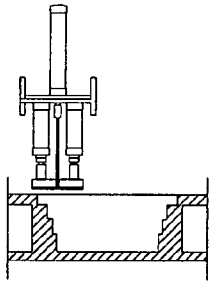
Figure 3A:
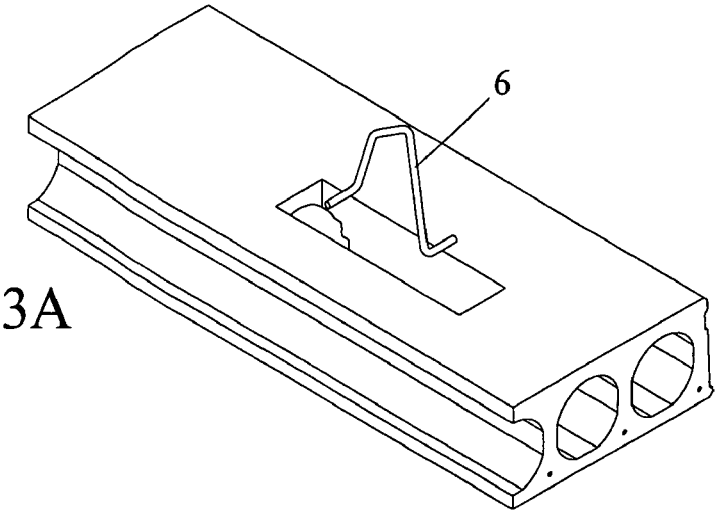
Figure 3B:
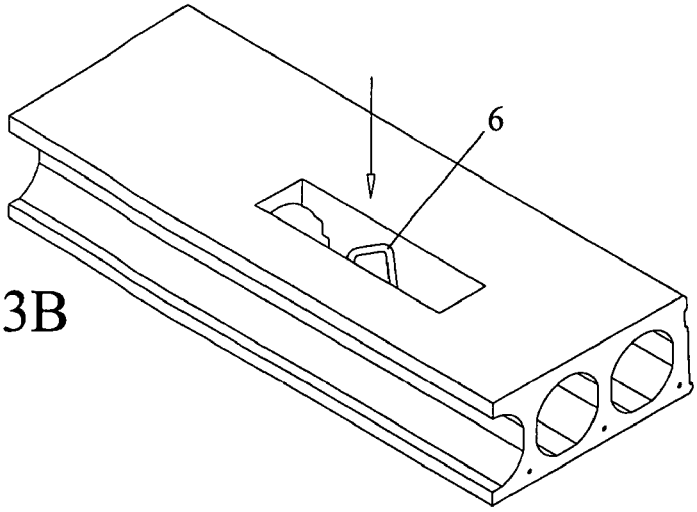
Figure 3C:
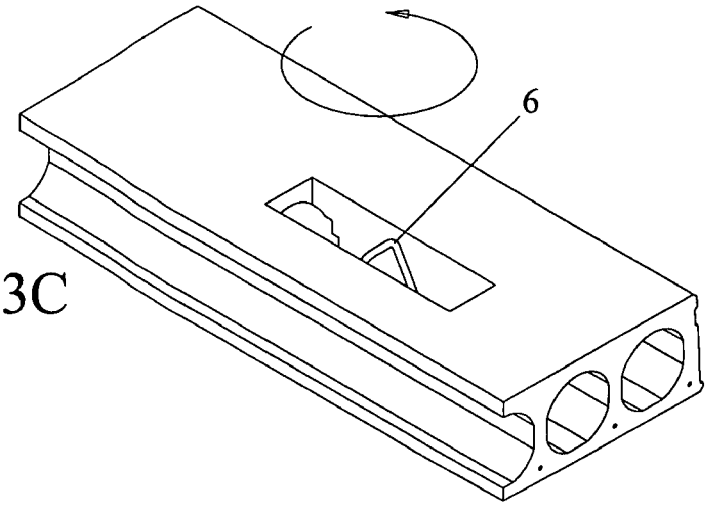
Figure 4:
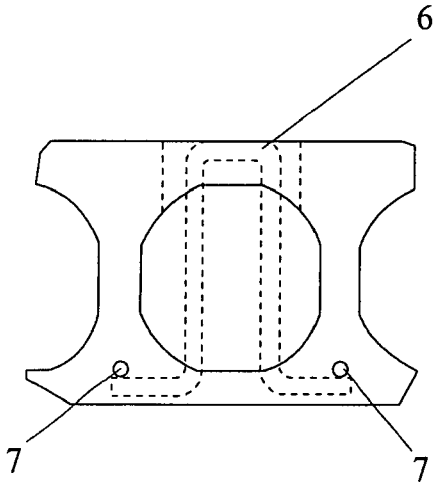
Figure 5:
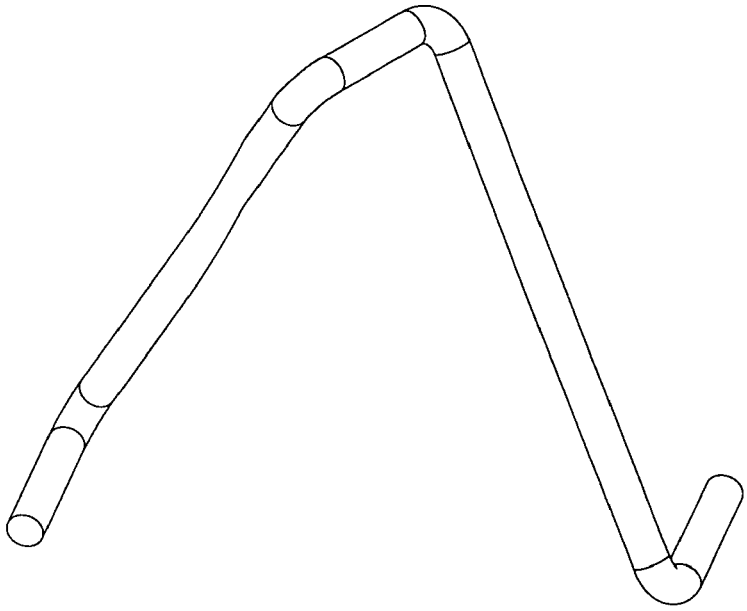
Figure 6:
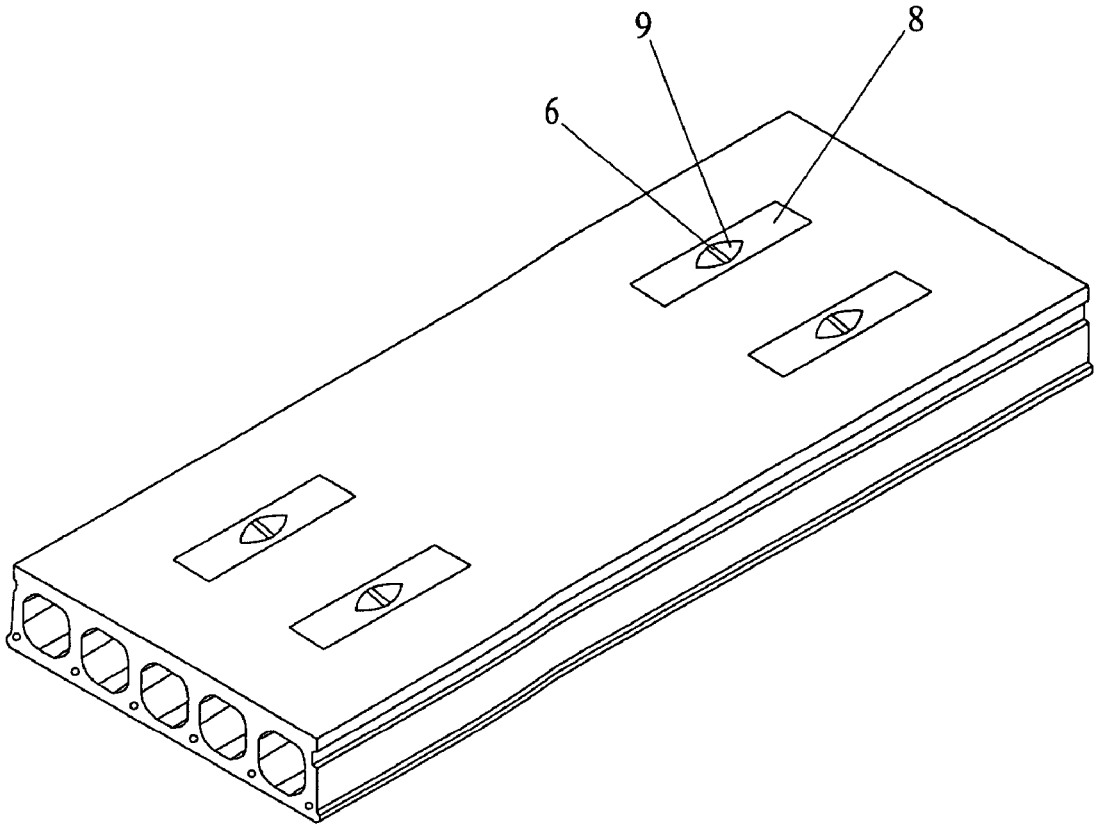

The invention will be described in more detail by means of example in the following, with reference to the enclosed drawings, wherein FIG. 1 is a schematic view of one apparatus in accordance with the invention, for breaking the surface of the hollow-core slab at the hollow core, and for closing the ends of the hollow cores defined by the formed opening, FIGS. 2A-2P show schematically the operation of the apparatus shown in FIG. 1, FIGS. 3A-3C show schematically the phases of attaching the lifting lug to the opening formed to the hollow-core slab, FIG. 4 shows schematically how the part forming a lifting lug according to the invention is supported to the reinforcing strands of the hollow-core slab, FIG. 5 shows one part forming a lifting lug used in a solution in accordance with the present invention, FIG. 6 shows one ready hollow-core slab equipped with the lifting lugs according to the invention, FIG. 1 shows an apparatus for breaking the surface of the hollow-core slab at the hollow core and for closing the hollow cores defined by the formed opening. The apparatus comprises a frame 1, two pressing cylinders 2 driving the pressing means 5 of the apparatus and a pressing cylinder 3 of a support plate driving the support plate 4.

The operation of the apparatus of FIG. 1 is described in the following with reference to FIGS. 2A-2P. First, the apparatus is placed as shown in FIG. 2A above the upper surface of the hollow-core slab and in the middle of the cavity to be formed, in a longitudinal direction of the hollow-core slab.

After the apparatus has been positioned, the upper surface of the fresh hollow-core slab is broken by pushing the support plate 4 by means of the pressing cylinder 3 of the support plate as shown in FIG. 2B through the upper surface of the hollow-core slab and to the space formed by the hollow core so that the side and lower surfaces of the support plate set themselves substantially to the level of the side and lower surfaces of the hollow core, and the support plate is left in this position.

Next, as shown in FIG. 2C, the pressing means 5 is pressed by means of the pressing cylinder 2 through the upper surface of the fresh hollow-core slab, whereby the pressing means breaks a piece of fresh concrete mass having the same width as the pressing means, from the upper surface of the hollow-core slab and drops it to the lower surface of the hollow core of the hollow-core slab.

Then, as shown in FIG. 2D, the apparatus is moved laterally in the longitudinal direction of the hollow core of the hollow-core slab to the direction of the broken upper surface of the hollow-core slab, whereby the support plate 4 moves concrete mass dropped to the bottom of the hollow core under the upper surface of the hollow-core slab. As shown in FIG. 2D, the broken concrete mass is preferably not totally moved below the unbroken upper surface of the hollow-core slab, but the support plate 4 is left to a small distance of the edge thereof.

Next, as shown in FIG. 2E, the breaking of the upper surface of the hollow-core slab is repeated by means of the pressing means 5 and the pressing cylinder 2, whereby the fresh concrete mass broken from the upper surface of the hollow-core slab drops almost totally on top of the concrete mass earlier broken from the upper surface of the hollow-core slab, thus growing the heap of concrete mass on the bottom of the hollow core.

After that, as shown in FIG. 2F, the broken concrete mass lying on the bottom of the hollow core is again moved under the unbroken upper surface of the hollow-core slab by means of the support plate 4, and a new part of the upper surface of the hollow-core slab is broken as shown in FIG. 2G on top of the concrete mass on the bottom of the hollow-core slab by means of the pressing means 5 and the pressing cylinder 2.

Now, the amount to plug the hollow core has been reached in form of a heap in the hollow core, and the final plugging or closing of the hollow core happens as shown in FIG. 2H, by moving by means of the support plate 4 the broken concrete mass at least partly under the unbroken upper surface of the hollow-core slab.

When the first end of the hollow core defined by the opening formed to the upper surface of the hollow-core slab has been plugged, the apparatus is moved in the longitudinal direction of the hollow core to touch the opposite edge of the opening. Then, the hollow core is plugged in the corresponding way as described above by means of the identical breaking means of the upper surface of the hollow-core slab, as shown in FIGS. 2I-2P.

As described above, an opening has now been formed to the hollow-core slab, the hollow cores defined by the opening being closed. In the following, the attaching of the lifting lug will be described with reference to FIGS. 3A-3C showing the mounting phases of the lifting lug.

As shown in FIG. 3A, the lifting lug or the part 6 forming the lifting lug is first brought above the opening formed into the hollow-core slab, and then lowered to the opening aligned, as shown in FIG. 3B. Finally, the lifting lug 6 is turned as shown in FIG. 3C to its final position, whereby the end parts of the part forming the lifting lug are pushed inside the necks of the cast hollow-core slab, and there under the reinforcing strands.

For closing the formed opening, it is filled with fresh concrete mass, which is compacted by vibrating. The filling of the opening can be performed before mounting of the part 6 forming the lifting lug, during the mounting or after the mounting thereof. Preferably, the filling of the opening is performed at the same time as the positioning of the part forming the lifting lug, and the concrete mass forming the filling is vibrated at the same time, whereby the vibratory effect of the vibrating plasticizes the concrete mass of the hollow-core slab thus facilitating the penetration of the end parts of the part 6 forming the lifting lug into the hollow-core slab, and the concrete mass to be used as filling can penetrate the fractures and holes eventually formed in the hollow-core slab in connection with the mounting of the lifting lug.

The lifting lug 6 is mounted in the hollow-core slab preferably so that the uppermost surface of the lifting lug remains on the level of the upper surface of the hollow-core slab or below it, whereby a cavity is formed for the lifting lug in the cast filling concrete at the lug. In this way the use of filler concrete needed at the installation phase of the hollow-core slab at the building site can be minimized.

FIG. 4 shows the supporting of one part 6 forming the lifting lug to the reinforcing strands 7 of the hollow-core slab, when the part 6 forming the lifting lug has been positioned in place in the opening formed in the hollow-core slab.

FIG. 5 shows an example of a part forming the lifting lug to be used in a solution in accordance with the invention, said part corresponding to the part 6 shown in FIGS. 3A-3B and 4.

FIG. 6 shows a ready-made hollow-core slab equipped with lifting lugs in accordance with the invention. After the parts 6 forming the lifting lug have been positioned in place, during it or before the positioning, the openings have been filled with filling concrete 8 that has been compacted during the positioning of the lifting lug or after that by vibrating. In connection with the compacting of the filling concrete 8, a cavity 9 has been formed in the filling concrete, through which the lifting lug can be used, said cavity being preferably located having its upper surface at the level of the upper surface of the hollow-core slab or slightly below it.

Attaching of the part forming the lifting lug in accordance with the present invention to the fresh slab equipped with the reinforcing strands can also be implemented in the most simple way so that the part forming the lifting lug is embedded by vibrating through the upper surface of the slab into the slab so that when the part forming the lifting lug has its upper edge substantially at the upper level of the slab, the part forming the lifting lug is turned so that the lower ends of the lifting lug set themselves under the reinforcing strands of the slab.

In addition, this kind of a solution can be advantageously implemented with massive slabs, that means slabs having a solid cross section. In addition, in this embodiment of the invention, the cavity or space to be formed to the upper surface of the slab around the lifting lug, essential for the use of the lifting lug, can be advantageously formed by the formation of the tool or device to be used for embedding or with a part to be separately attached thereto, that forms said space in connection with the embedding by vibration or at the final phase thereof. Preferably the forming of this space happens when the part forming the lifting lug is turned.

With this embodiment of the invention, it is possible to position the lifting lug relatively freely over the total width of the cast slab.

By means of the solution in accordance with the invention, it is possible to significantly emphasize the attachment of the lifting lug to the cast slab, whereby the probability that the lifting lug will be eventually torn off is significantly decreased, and correspondingly, eventual dangerous situations caused by tearing off when lifting the slabs can be avoided.

The invention claimed is:

1. An apparatus for attaching a part forming the lifting lug to a fresh hollow-core concrete slab or massive concrete slab provided with reinforcing strands, wherein the apparatus comprises: a vibrator adapted to vibrate concrete in the vicinity of the lifting lug and a positioning device adapted to turn the lifting lug so that the lifting lug is supported by the reinforcing strands.

2. An apparatus in accordance with claim 1, wherein the apparatus further comprises a support plate adapted to break an upper surface of the hollow-core slab at the hollow core, thereby forming an opening therein.

3. An apparatus in accordance with claim 2, wherein the apparatus further comprises one or more pressing plates adapted to plugging the ends of the hollow core defined by the formed opening.

* * * * *